United States Patent [19]

Reinelt

[11] Patent Number: 4,949,640

[45] Date of Patent: Aug. 21, 1990

[54] PROPELLANT CHARGE CONTAINER

[75] Inventor: Karlheinz Reinelt, Hermannsburg, Fed. Rep. of Germany

[73] Assignee: Rheinmetall GmbH, Duesseldorf, Fed. Rep. of Germany

[21] Appl. No.: 710,144

[22] Filed: Mar. 11, 1985

[30] Foreign Application Priority Data

Mar. 9, 1984 [DE] Fed. Rep. of Germany ... 8407198[U]

[51] Int. Cl.[5] ..... F42B 9/24

[52] U.S. Cl. ..... 102/282; 206/3

[58] Field of Search ..... 102/282; 206/3; 222/553, 548

[56] References Cited

U.S. PATENT DOCUMENTS

| | | | |
|---|---|---|---|
| 297,345 | 4/1884 | Boca | 102/282 |
| 533,862 | 2/1895 | Brabrook | 222/548 |
| 602,467 | 4/1898 | Norton | 222/548 |
| 662,353 | 11/1900 | Clement | 222/553 |
| 810,060 | 1/1906 | Leathers | 206/3 |
| 1,625,631 | 4/1927 | Spotswood | 102/282 |
| 2,977,015 | 3/1961 | Bartlett | 215/76 |
| 3,058,630 | 10/1962 | Abt | 222/548 |
| 3,120,185 | 2/1964 | Lipinski | 102/38 |
| 3,771,460 | 11/1973 | Ayer | 102/282 |

FOREIGN PATENT DOCUMENTS

| | | | |
|---|---|---|---|
| 1396901 | 3/1965 | France . | |
| 0225057 | 11/1924 | United Kingdom | 222/548 |

*Primary Examiner*—Robert A. Rose

*Attorney, Agent, or Firm*—Klein & Vibber

[57] ABSTRACT

The invention relates to a propellant charge container for receiving loose propellant charge powders. The propellant charge container consists of at least two separate telescopically mounted cylindrical parts which are mutually rotatable relative to each in the peripheral direction. The propellant charge container has a substantially cylindrical shape. The cylindrical container parts forming the container are coupled to each via their mutually overlapping regions. Each of the respective overlapping regions of the parts forming the container have at least one opening, which openings can be mutually aligned to form a filling opening. When these openings are misaligned the filling opening is closed. The overlapping regions of the cylindrical parts have one or more annular corrugations which interengage to form a firm coupling between the cylindrical parts forming the propellant charge container. Both of the end faces of the cylindrical parts forming the container have indentations for permitting a radially and axially play-free loading. The novel propellant charge container of this invention provides for significant manufacturing savings and accelerates the loading process.

5 Claims, 1 Drawing Sheet

PROPELLANT CHARGE CONTAINER

BACKGROUND OF THE INVENTION

Propellant charge containers serve to receive propellant charge and igniter powders and find particular application in artillery weapons in which the projectile and propellant charge are separately loaded into the gun barrel.

Conventional propellant charge containers, for example as those illustrated in the WAFFENTECHNISCHES TASCHENBUCH der Firma Rheinmetall, Fifth Edition, 1980, page 516, can be used for transporting portions of propellant charge powder forming different types of charges, which are removed from the transport container prior to the loading process.

SUMMARY OF THE INVENTION

The improvement of this invention resides in providing a new type of propellant charge container, which, on the one hand, simplifies the loading process, and, on the other hand, provides a particularly advantageous construction which reduces the manufacturing cost.

The novel propellant charge container of this invention provides significant savings in its logistic, in view of the fact that an additional container for the transporting of the propellant charge container is dispensed with. The novel construction of the propellant charge container of this invention makes it possible to automate the loading process, whereby the firing sequence can be increased.

Finally, the new type of propellant charge container makes possible manufacturing cost savings, since the filling and sealing of the propellant charge container requires no complex manufacturing steps or special tools.

BRIEF DESCRIPTION OF THE DRAWING

With these and other objects in view, which will become apparent in the following detailed description, the present invention, which is shown by example only, will be clearly understood in connection with the accompanying drawing, in which.

DETAILED DESCRIPTION

Figure 1:
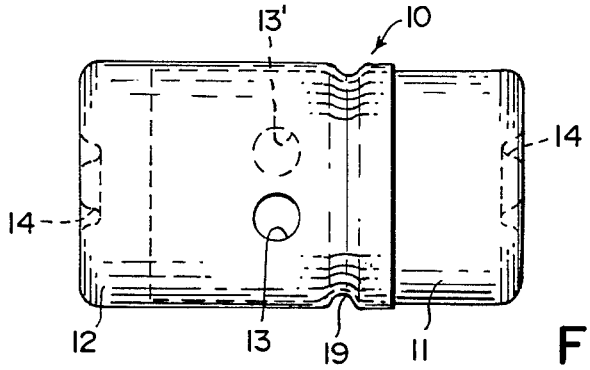
FIG. 1 is a side-elevational view of a first embodiment of the new type of propellant charge container of this invention.

The propellant charge container is substantially cylindrically shaped and consists of two mutually rotatable parts, such as the two cylindrically shaped parts 11, 12. In a particularly advantageous embodiment the propellant charge container consists of two unilaterally closed hollow cylinders with slightly differing outer diameters. The confronting open end faces of the two hollow cylinders are slid one over the other and after they have been so telescopically slid one over the other, they are held together, for example, by means of one or more annularly shaped interengaging corrugations in a mutually predetermined position. There is provided an opening 13, 13' in each one of the overlapping cylindrically shaped wall surfaces of the parts forming the propellant charge container. These openings 13, 13' which, for example, may be of circular shape, can be adjustably positioned relative to each other by rotating the corresponding propellant charge container parts in a peripheral direction, so that they either are aligned with respect to each other to first form a filling opening for introducing the propellant charge powder, or when they are misaligned with respect to each other, effect a closing of the filling opening. Therefore, there is no additional step required, other than the step of a mutual rotation of the propellant charge container parts 11, 12, for causing a closing of the propellant charge container. Therefore, also in this sense the preparation of the propellant charge container is simplified and cost-saving.

The propellant charge container is preferably made out of a combustible material, which material is per se known for use in cartridged ammunition.

A corrugation 14 is provided in the bottom as well as in the cover of the propellant charge container 10, which during the loading process permits a radial and axial play-free fixing of ignites.

Figure 2:
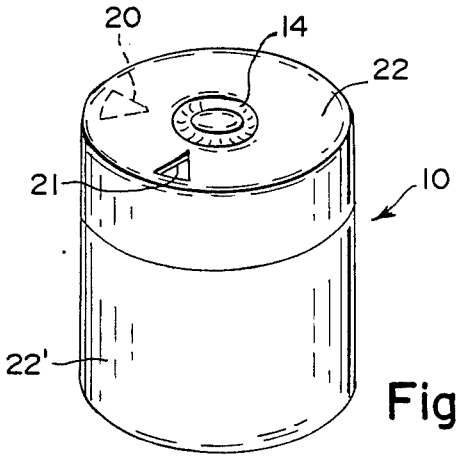
FIG. 2 is a perspective view of a further embodiment of the propellant charge container of this invention.

In a further embodiment of the invention (FIG. 2) the propellant charge container is substantially closed on all of its sides and only has an opening 20 in one of the end walls and a second opening 21 in a second cover 22. The cover 22 has a cylindrical skirt which is rotatable about a corresponding cylindrical portion of slightly smaller diameter of the propellant charge container 10. Therefore, by means of a simple rotation of the cover 22 relative to the container portion 22' the openings, 20, 21 can be brought into alignment for purposes of exposing an opening for filling the propellant charge container 10 with propellant charge powder and can then be mutually turned to seal the individual openings 20, 21.

As a result of the compact construction and identical outer dimensions the propellant charge containers 10 of this invention are particularly well suited for purposes of automating the loading process thereby increasing the capacity of the weapon, which makes possible a higher firing cadence.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

I claim:

1. A propellant charge container for holding loose propellant charge powder, wherein said container consists of two combustible parts which have substantially cylindrical shapes and said two parts are rotatably telescopically mounted relative to each other, each part of said container has a cylindrically shaped wall surface, said cylindrically shaped wall surfaces of a first part of two parts overlaps the cylindrically shaped wall surfaces of the second part of said two parts over a predetermined region in each part, wherein each part has at least one wall to form at least a pair of abutting and overlapping surfaces of said container and mutually engaging corrugations in said pair of abutting wall surfaces, each one of said overlapping wall surfaces having at least one opening said openings overlapping upon rotation of one of said parts with respect to the other of said parts.

2. The propellant charge container according to claim 1, wherein each part has at least one axial end wall to form at least a pair of abutting and overlapping axial end wall surfaces, each one of said overlapping axial end wall surfaces having at least one opening.

3. The propellant charge container according to claim 2, wherein each one of the axial end wall surfaces of said container has as mutually engaging corrugation with the other abutting axial end wall surface.

4. The propellant charge container according to claim 3, wherein said overlapping wall surfaces have annular corrugations which mutually matingly engage each other after the parts forming the container have been assembled to prevent an unintentional disassembly.

5. The propellant charge container according to claim 1, wherein said cylindrically shaped overlapping wall surfaces have mutually engaging mating annular projections and recesses which form a connection with a rotational movement but prevent an axial movement of the two parts relative to each other.

* * * * *